United States Patent [19]

Poole

[11] 4,182,526

[45] Jan. 8, 1980

[54] BUSINESS FORMS STATIONERY ASSEMBLY

[75] Inventor: William Poole, Dover, N.H.

[73] Assignee: Moore Business Forms, Inc., Grand Island, N.Y.

[21] Appl. No.: 890,638

[22] Filed: Mar. 20, 1978

[51] Int. Cl.[2] ..... B41L 1/20

[52] U.S. Cl. ..... 282/21 R; 282/11.5 A

[58] Field of Search ..... 282/21 R, 11.5 A, 11.5 R, 282/12 A, 21 C

[56] References Cited

U.S. PATENT DOCUMENTS

| | | | |
|---|---|---|---|
| 3,066,957 | 12/1962 | Huffman | 282/11.5 A |
| 3,112,125 | 11/1963 | Darrow | 282/11.5 A |
| 3,303,083 | 2/1967 | Hedenstrom | 282/11.5 A X |
| 3,495,852 | 2/1970 | Vath | 282/11.5 A |

*Primary Examiner*—Robert L. Spicer, Jr.

*Attorney, Agent, or Firm*—Allegretti, Newitt, Witcoff & McAndrews

[57] ABSTRACT

An improved business forms stationery assembly including plurality of continuous record webs that are disposed one on top of the other and that may be folded in zig-zag fashion, into a pack of alternate fold lengths. The record webs are joined together by a plurality of paper staple tongues that are oppositely directed in alternate fold lengths of the stationery assembly.

6 Claims, 2 Drawing Figures

BUSINESS FORMS STATIONERY ASSEMBLY

BACKGROUND AND SUMMARY OF THE INVENTION

The present invention relates to business forms stationery assemblies, and more particularly, to an improved business forms stationery assembly which includes a plurality of continuous record webs that are disposed one on top of the other and that are adapted to be folded, along transverse fold lines and in a zig-zag fashion, in a pack of alternate fold lengths.

It is known to secure together the parts of a business forms continuous stationery assembly by various means so that the assembly can be folded, in zig-zag fashion, into a pack and so that when folded in a pack, the stationery assembly, can be fed through a data processing machine, such as a typewriter or other printing machine. The parts of the stationery assembly of this type are usually secured together at and along one marginal side edge and are provided along one or both marginal side edges with a continuous longitudinal row of accurately punched feed apertures. The pins of the feed tractor or other similar feeding device of a data processing machine are adapted to engage these punched feed apertures for moving the stationery assembly through the data processing machine and maintaining accurate sheet-to-sheet registration. When such stationery assemblies are fed from a position, in a folded zig-zag pack, to a straight or "in line" position, as when they are being fed to and run through a data processing machine, it is difficult for the stationery assemblies to assume this straight or "in line" position because all the parts of the assemblies are secured together. Consequently, the stationery assemblies are sometimes distorted adjacent each fold line. This distortion is referred to as "tenting".

British Patent Specification No. 919497 describes a stationery assembly in which transverse slits are formed in the marginal side edges of the webs of the stationery assembly to permit the parts of the stationery assembly to be secured relatively to the other parts of the assembly. It is also known to secure the parts of a stationery assembly together by paper staples, for example, as described in British Patent Specification No. 1376447, to provide a limited flexibility between the parts of the stationery assembly.

BRIEF SUMMARY OF THE INVENTION

The improved business form stationery assembly of the present invention comprises at least three continuous, longitudinal record webs that are disposed one on top of another, and that are folded, along transverse fold lines in zig-zag fashion, into a pack of alternate fold lengths. The record webs are joined together by a plurality of paper staple tongues that are integral with an outer record web in the assembly, that extends through apertures in each of the intermediate record webs and that are secured, at their free or distal ends, to the other outer record web. It has been found that particularly improved results, in terms of ease of feeding and running the assembly in data processing machines, can be achieved when the free ends of the paper staple tongues are integral with the uppermost web and are oppositely directed, in pairs of alternate fold lengths of the stationery assembly, toward the adjacent fold lines.

DESCRIPTION OF THE DRAWINGS

A business forms continuous stationery assembly in accordance with the present invention will now be described by way of example with reference to the accompanying drawings wherein.

DETAILED DESCRIPTION OF THE PREFERRED EMBODIMENT

Figure 1:
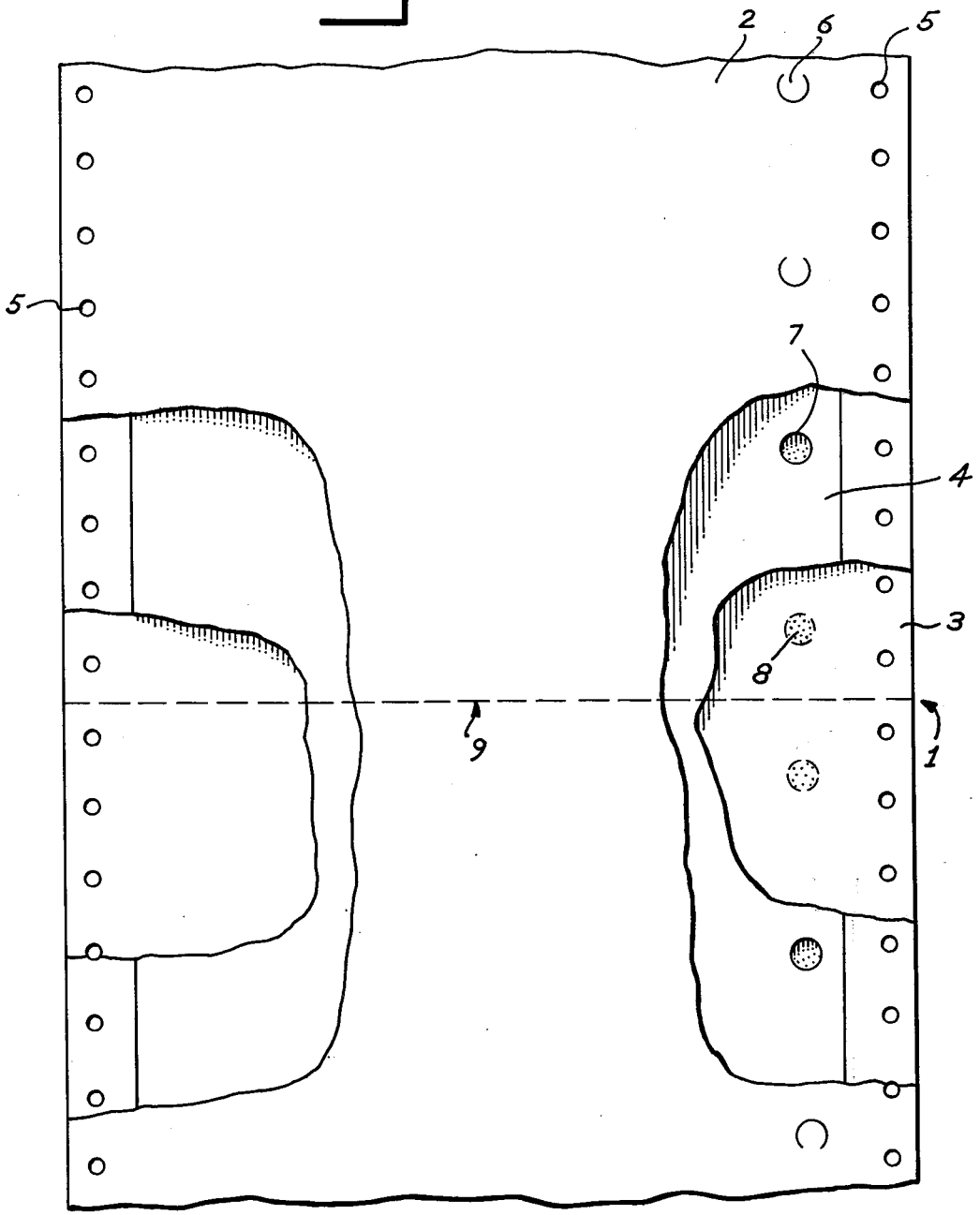
FIG. 1 is a top plan view, partly cut away of part of two fold lengths of the continuous stationery assembly of the present invention shown in the "in line" position.

With reference to the drawings, a stationery assembly is shown generally at 1 and comprises a first record web 2, a second record web 3 and an intermediate record web 4. For the sake of clarity only one intermediate record web has been shown in FIG. 2 but an additional number of intermediate record webs, as well as corresponding transfer webs, such as for example, carbon paper, could well be embodied in the assembly 1 if desired.

A continuous evenly spaced, longitudinal line of marginal feed perforations 5 is provided in and along each side marginal edge of each of the record webs 2–4. These perforations are adapted to be engaged by feed pins of a data processing machine for feeding the assembly through such a machine. Any transfer webs that may be included in the assembly 1 would normally be narrower than the record webs 2–4, and their outer side marginal edges would not extend as far as the feed perforations 5. The transfer webs could, however, have the same width as the record webs 2–4.

A plurality of paper staple tongues 6 are cut out of the first web 2 of the assembly 1 by virtue of a partially circular cut in the web 2. These paper staple tongues 6 are formed at intervals lengthwise of the webs in a line extending longitudinally of the assembly. The paper staple tongues 6 are in register with apertures 7 in the intermediate record web 4, and in any transfer webs utilized with the assembly 1. Spots of adhesive 8 are disposed on the under face of the second web 3 so that when the paper staple tongues 6 are pushed through the apertures 7 in the transfer web 4, and free or distal ends of each paper staple tongue 6 is in contact with and secured to a spot of adhesive 8 in the second record web 3. This is more clearly shown in FIG. 2.

The webs 2–4 are divided into alternate fold lengths by transverse fold lines, of cross perforations, designated generally at 9. The paper staple tongues 6 are located in such a way that their free ends are directed from the first, uppermost record web 2, through the apertures 7 in the intermediate record web 4, and any included transfer webs, and are secured to the spots of adhesive 8 on second, lowermost record web 3. The free ends of the paper staple tongues 6 in an adjacent pair of alternate fold lengths face towards the common fold line 9 between the pair of fold lengths and as shown in FIG. 2, the first, uppermost record web 2 of the assembly 1 is disposed on the outside of the fold.

Figure 2:
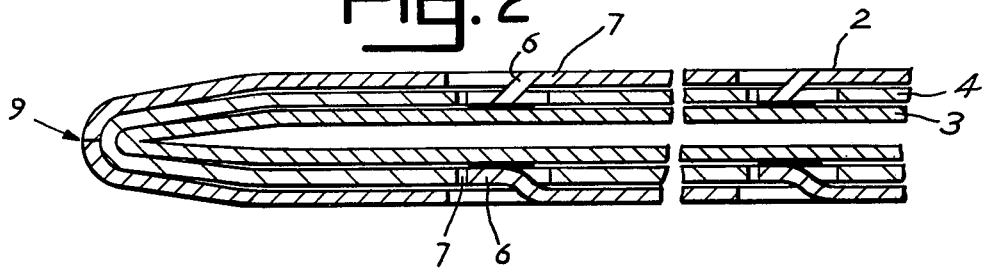
FIG.2 is a cross sectional view of part of two form lengths of the stationery assembly, but without transfer webs as shown in FIG. 1, in a folded condition.

Because of the distortion of the paper staple tongues 6 when the assembly 1 is folded, as shown in FIG. 2, the record webs 2–4 are permitted to move relatively to each other in one direction when the record webs are folded. The record webs 2–4 can move relatively to each other in the opposite direction when they are unfolded. This enables the assembly 1 to be displaced by a limited amount during folding but to return to the position shown in FIG. 1 when the assembly is disposed in an "in line" position so that they may be fed through a data processing machine such as a typewriter or line printer.

The paper staple tongues 6 and complementary apertures 7 are preferably positioned in a line at one side of the assembly 1 within the line of feed apertures 5. The paper staple tongues 6 may be a diameter of about 3/16ths of an inch, and the apertures 7 may have a diameter of about ¼ of an inch. A paper staple tongue 6 may be positioned between each pair of feed apertures 5, or as shown in FIG. 1, may be inwardly spaced from the line of feed apertures 5 about 1¼ inches.

The assembly 1, as described and shown in the drawings, would be suitable for an assembly including about six parts. If more than six parts are required to be included in an assembly, it may be necessary to employ one set of paper staple tongues 6 to join, say, the first six parts of the assembly, and another, separate set of paper staple tongues 6 to join the last six parts of the assembly. Also, if required, a paper staple tongue 6 may be cut out of the sixth part of a set, that is, with the tongue 6 positioned midway between the tongues 6 of the first to fifth parts to join the sixth to twelfth parts together. Furthermore, the paper staple tongues 6 joining the sixth to twelfth parts may overlie the tongues of the first part; with the tongues of the first part overlapping the paper staple tongue 6 of the sixth part.

The embodiment of the present invention shown in FIGS. 1 and 2 includes record webs 2 and 4 with an interleaved record web 3. Transfer webs, such as carbon paper webs, may be interleaved between the record webs 2 and 3 and between the record webs 3 and 4. However, it will be apparent to those having skill in this art that the assembly 1 may comprise record webs having a coating on one or both of their faces to effect transfer to data applied to the uppermost web 2, as by typing or writing pressure, to the underlying webs. Such webs are sometimes referred to as selfmanifolding paper webs.

Thus, since the invention disclosed herein may be embodied in other specific forms without departing from the spirit or central characteristics thereof, the preferred embodiment described herein is therefore to be considered in all respects as illustrative and not restrictive, the scope of the invention being indicated by the appended claims, rather than the foregoing description, and all changes which come within the meaning and range of equivalency of the claims are therefore intended to be embraced therein.

What I claim is:

1. An improved business forms continuous stationery assembly for use with a data processing machine having a pin feed tractor for moving the stationery assembly through the machine and comprising:

a plurality of continuous, longitudinal record webs, including a first record web, and at least a second record web, the record webs being disposed one on top of the other and being capable of being folded, along transverse fold lines, in zig-zag fashion, into a pack of alternate folded lengths and being unfolded so that the webs may again assume a straight line position for use in the data processing machine, with each adjacent alternate folded lengths having a common, transverse fold line therebetween and with each of the record webs having a plurality of evenly spaced pin feed apertures therein that are disposed along at least one side marginal edge of the record webs; and means for permitting relative movement between the record webs in each adjacent alternate folded length when the record webs are folded and unfolded about the common transverse fold line between the adjacent alternate folded length, the relative movement means including: a plurality of paper staple tongues in the outer one of the record webs, as the record webs are folded about the common transverse fold line in each adjacent alternate folded length, the paper staple tongues each having a free end and being arranged so that the free ends of the paper staple tongues in adjacent, alternate fold lengths face toward the transverse common fold line between the adjacent, alternate fold lengths of the stationery assembly; and means for securing the free ends of the paper staple tongues to the other record web so that the record webs may move relatively to one another in either direction parallel to the side marginal edge of the record webs.

2. The improved business forms continuous stationery assembly as described in claim 1 wherein the first outer record web of the assembly is disposed on the outside of the fold; and wherein the means for securing the free end of the paper staple tongue are spots of adhesive on the inner facing face of the other outer record web.

3. The improved business forms continuous stationery assembly as described in claim 1 wherein the relative movement means are disposed along one longitudinal marginal side of the assembly.

4. The improved business forms continuous stationery assembly as described in claim 1 wherein feed apertures are disposed along a longitudinal line adjacent to one side marginal edge of the assembly; and wherein the relative movement means are disposed along the same longitudinal line and between the feed apertures.

5. The improved business forms as described in claim 1 wherein the stationery assembly includes at least one intermediate, interleaved record web disposed between the first and second webs; wherein each intermediate record web has a plurality of cooperating apertures therein; and wherein the intermediate record webs, and the cooperating apertures therein, are disposed, with respect to the first and second record webs, so that a cooperating aperture is disposed adjacent to a paper staple tongue in the adjacent outer, one record web and so that the free end of the paper staple tongue may pass through the cooperating aperture and contact the other record web.

6. The improved business forms as described in claim 5 wherein a plurality of intermediate record webs are disposed between the first and second record webs.

* * * * *